US005240504A

United States Patent [19]

Mazakas

[11] Patent Number: 5,240,504

[45] Date of Patent: Aug. 31, 1993

[54] SPRAY BOOTH LINER

[76] Inventor: Russell Mazakas, 1691 Solano, Ontario, Calif. 91764

[21] Appl. No.: 851,743

[22] Filed: Mar. 16, 1992

Related U.S. Application Data

[63] Continuation-in-part of Ser. No. 725,021, Jul. 3, 1991, abandoned.

[51] Int. Cl.[5] ..... B05C 15/00; B05B 15/12

[52] U.S. Cl. ..... 118/634; 427/421; 118/309

[58] Field of Search ..... 118/634, 309, 326; 55/DIG. 46; 52/79.5, 2.11, 2.15, 2.25; 427/421

[56] References Cited

U.S. PATENT DOCUMENTS

| | | | |
|---|---|---|---|
| 3,388,509 | 6/1968 | Mora | 52/2.15 |
| 3,924,363 | 12/1975 | Candle | 52/2.19 |
| 4,021,972 | 5/1977 | Choate et al. | 52/2.15 |
| 4,478,012 | 10/1984 | Fraioli | 52/2.25 |
| 4,924,803 | 5/1990 | Celant | 118/326 |
| 5,107,789 | 4/1992 | Salisbury | 118/305 |
| 5,149,373 | 9/1992 | Gondrand | 118/634 |

FOREIGN PATENT DOCUMENTS

89/02788 4/1989 World Int. Prop. O. .

*Primary Examiner*—W. Gary Jones
*Assistant Examiner*—Charles K. Friedman
*Attorney, Agent, or Firm*—Blakely, Sokoloff, Taylor & Zafman

[57] ABSTRACT

A liner that covers the inner walls of a spray booth. The liner has cables that extend through holes in the booth. The user can pull the cables and lift the liner, so that the liner covers the inner walls of the booth. The cables are then fastened in place, such that the liner is suspended in an upright position. The liner prevents the electrostatic paint powder from adhering to the walls of the booth. The liner contains elastic material, so that when the cable is unfastened, the liner readily falls into a flat position. The user can then roll up the liner, remove the same from the booth and insert a new liner for a new color of paint. The liner may have ducts to direct the powder within the booth to a paint powder filter. The duct can be readily lifted and collapsed for easy installation within the booth.

8 Claims, 5 Drawing Sheets

FIG. 2
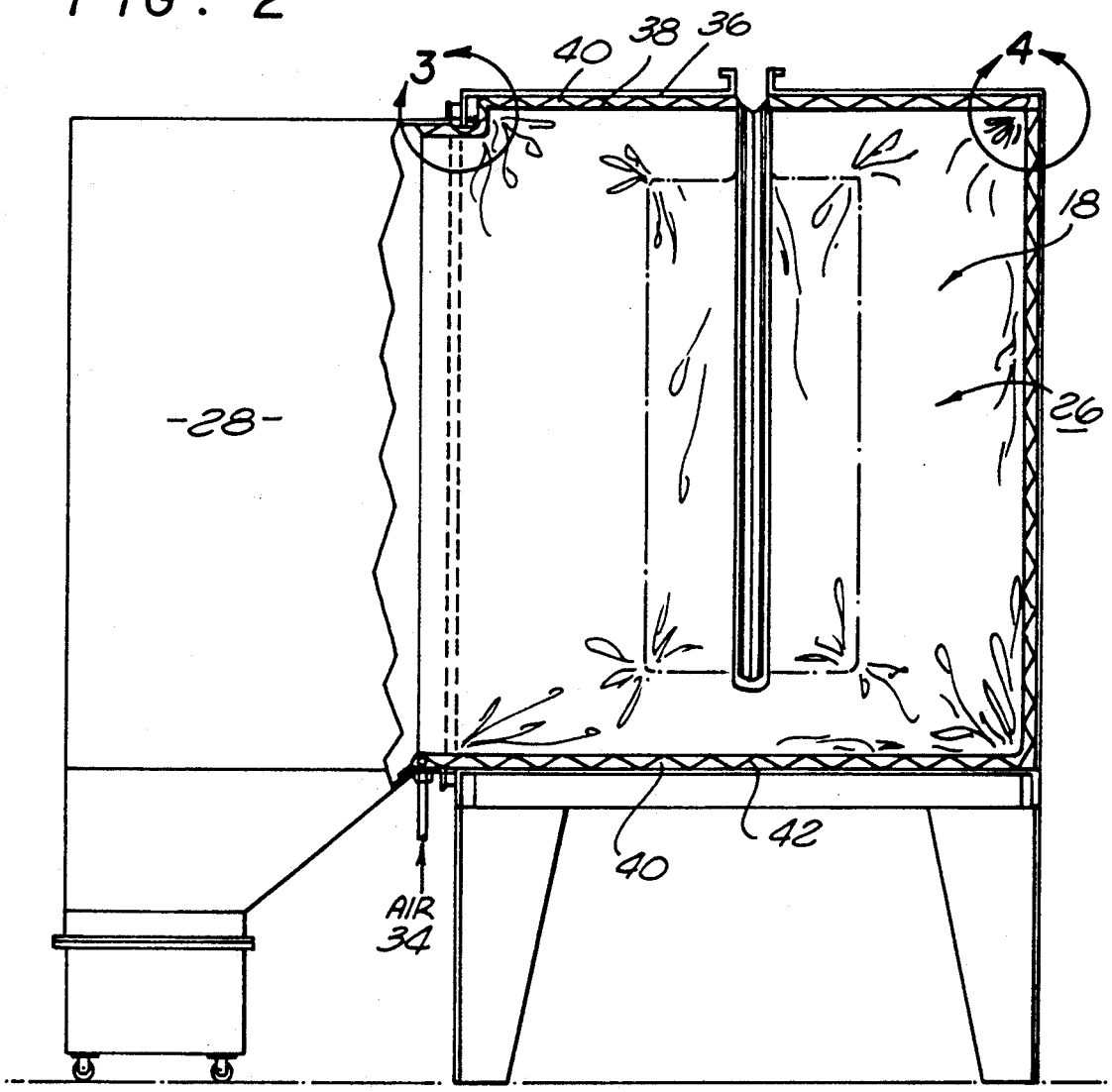
FIG. 3
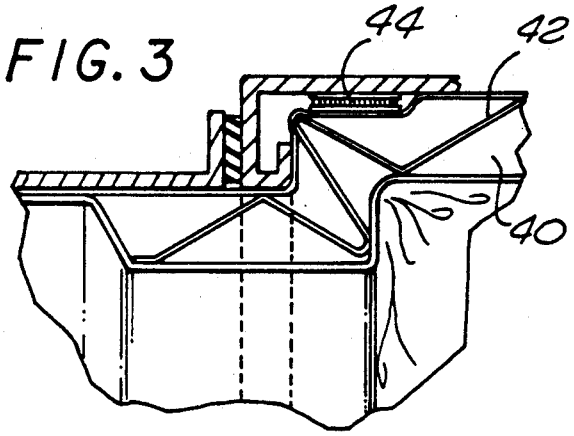
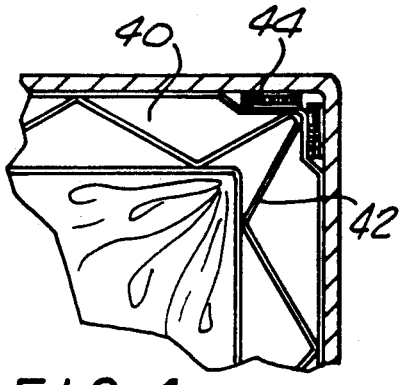
FIG. 4

SPRAY BOOTH LINER

This application is a continuation-in-part of application Ser. No. 07/725,021, filed on Jul. 3, 1991 now abandoned.

FIELD OF THE INVENTION

This invention relates to spray booths used to coat workpieces with electrically charged resin powder.

BACKGROUND OF THE INVENTION

Electrostatic powder paint spray booths are becoming much more common because of the hardened and improved finish provided by such methods, and the much reduced pollution resulting therefrom. This type of painting comprises spraying electrically charged paint powder onto workpieces that are at ground potential. The charged powder is attracted and adheres to the grounded workpieces, which are then baked in an oven to melt the powder, causing the powder to flow and cover the workpieces. Typically the pieces are hung on racks that pass through a spray booth, wherein a spray gun applies the powdered paint as the parts pass by. The booth is usually a rectangular box with entrance and exit openings, and a slot along the top to allow the hangers and parts to pass through the booth. The booths typically also have a filter system to remove and recover the excess powder that does not adhere to the parts, it being found that the powder will not stick to the pieces after a certain thickness of powder has built up on the part to neutralize the charge.

The spray gun and filter are usually a detachable unit so that it is easy to convert those parts of the spray booth system to a new color. Unfortunately the powdered resin also sticks to the inside of the rectangular booth, which is typically constructed from metallic walls that attract the charged paint powder. When the booth is converted to a new color, the inside of the booth must be cleaned of old powder to insure that none of the old color powder mixes with the new color powder. This is a costly, time consuming task that can shut down a whole assembly line for a long time.

U.S. Pat. No. 4,924,803 issued to Celant and Danish Reference No. 89/02788 by Andersen disclose a single plastic liner that covers the inside of the booth, wherein the liner can be removed and replaced by a different liner when a color change is desired. The single liner concept is difficult and dangerous to install. When the single liner is blown into place within the inside of the paint booth, air will leak out through the zippers and other necessary unsealable openings. Because the walls of the liner contain powder, the air that leaks out of the inflated cover will also contain powder. The powder is toxic, wherein the release of paint into the surroundings will create an undesirable environmental condition. Thus it is not practical to blow-up a single liner of the prior art with air to install it in the spray booth chamber. Additionally, both the Celant and Andersen devices require pressure or vacuum means to install and suspend the liners, thereby increasing the complexity and cost of the installation and overall assembly.

SUMMARY OF THE INVENTION

The present invention is a liner that covers the inner walls of a spray booth. The liner has cables that extend through holes in the booth. The user can pull the cables and lift the liner, so that the liner covers the inner walls of the spray booth. The cables are then fastened in place, such that the liner is suspended in an upright position. The liner prevents the electrostatic paint powder from adhering to the walls of the spray booth. The liner contains elastic material, so that when the cable is unfastened, the liner readily falls into a flat position. The user can then roll up the liner, remove the same from the booth and insert a new liner for a new color of paint. The liner may have ducts to direct the powder from the booth to a paint powder filter. The duct is constructed to be readily lifted and collapsed for easy installation within the booth.

Another embodiment of the invention includes a double wall inflatable liner that covers the inside of a powder paint spray booth. The liner has a first layer that conforms to the shape of the spray booth inner cavity and a second inside layer attached to the first layer such that there is an inflatable compartment between each layer. After the liner is placed in the booth, the liner can be inflated into place with compressed air between the inside and outside layers to provide a double walled liner that conforms to the inside of the spray booth. This double walled liner can be used in this state without having to attach the liner to the inside of the booth. The inflatable double layer can be sealed airtight. If the inflated double wall becomes punctured, the escaping air is clean and not laded with powder, helping to insure that the powder, which is toxic, does not escape the booth. The air gap between the layers also provides electrical insulation, so that the charged powder is not attracted to the grounded metallic walls of the booth. The inside layer can be constructed to allow the pressurized air to blow through the inside layer into the cavity, to further bias the powder away from the liner and metallic walls. This migration of compressed air into the booth through the inside liner assures that no powder clings to the booth walls. Thus accumulated powder will not block light coming into the booth through the liners. The liner may have zippers that unzip portions of the liner, creating openings and a slot that are similar in size and location with the openings and slots of the booth. The slot and openings allow the parts and hangers to pass through the liner and spray booth.

The liner can be attached to and stored in a portable cabinet which contains filters for a particular color powder. The cabinet can be easily detached and replaced by another cabinet, providing an easy method of changing the booth to a new color. When a change of color is desired the liner is deflated, packed into its portable filter cabinet and rolled away. A new color filter cabinet is placed next to the booth, wherein the liner is unfolded, inflated to conform to the cavity walls and unzipped to expose the slot and openings. The filter cabinets can be stored, so that each cabinet corresponds to a different color. For example, one cabinet and liner is used when red paint is sprayed, another cabinet and liner for blue paint etc, etc. The liner can be constructed so that when the cover is inflated, it conforms to the shape of the booth cavity and can be used in that state without requiring a suction chamber to attach the liner to the walls of the booth.

Therefore it is an object of this invention to provide a spray booth liner that is easy to install, prevents the attraction of the powder to the liner walls and insures that no powdered paint will escape the booth.

BRIEF DESCRIPTION OF THE DRAWINGS

The objects and advantages of the present invention will become more readily apparent to those skilled in the art after reviewing the following detailed description and accompanying drawings, wherein:

FIG. 2 is a side view of a double layered liner inflated and attached to the inner cavity of a spray booth;

FIG. 3 is an exploded view of FIG. 2, showing the attachment of the portable cabinet and liner to the spray booth;

FIG. 4 is an exploded view of FIG. 2, showing the attachment of the liner to a corner of the booth cavity and a corrugated member between the liner walls to add structural support to the liner;

DETAILED DESCRIPTION OF THE INVENTION

Figure 1:
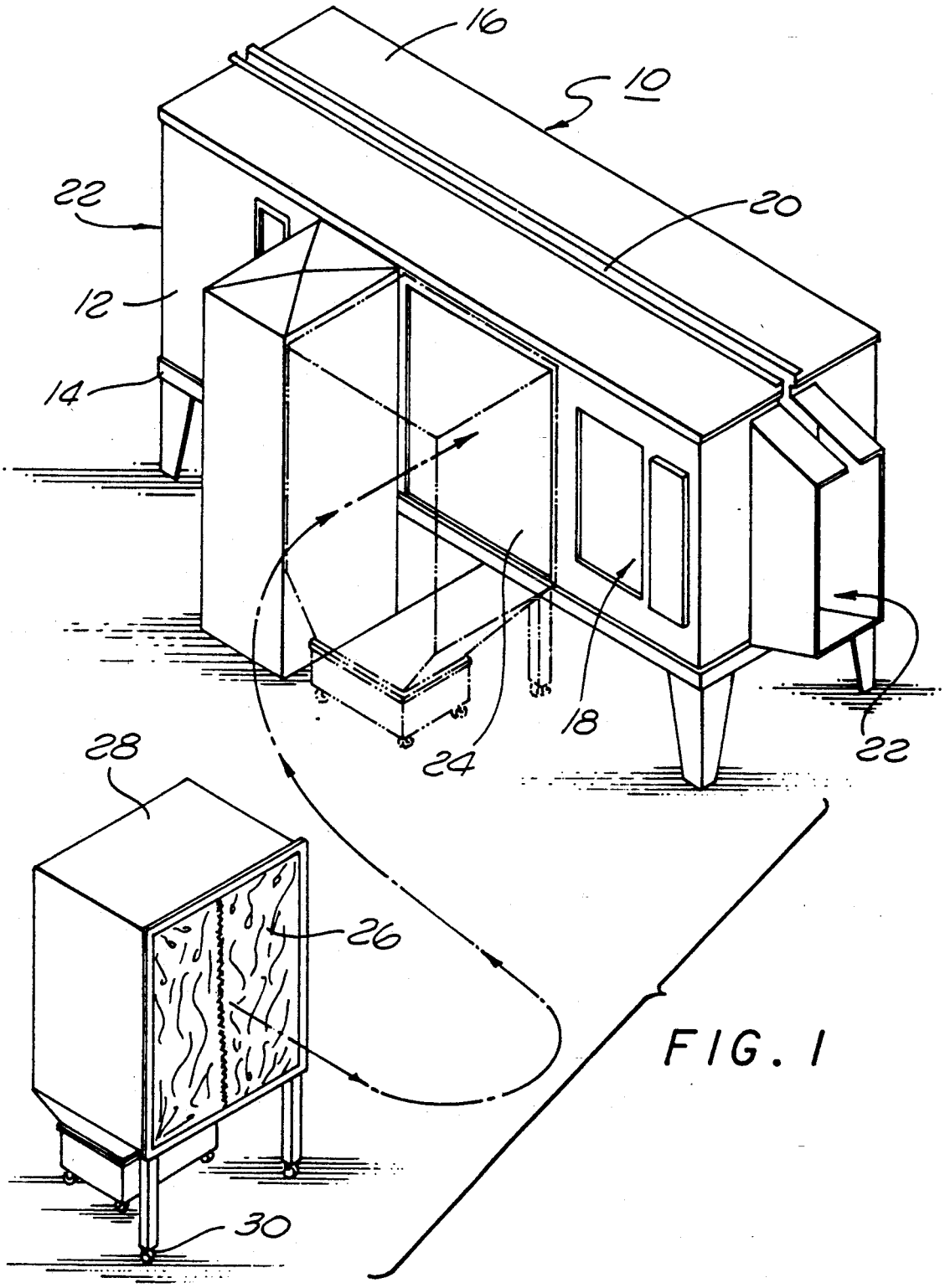
FIG. 1 is a perspective of a paint spray booth showing the attachment of a portable cabinet having an inflatable double layered liner.

Referring to the drawings more particularly by reference numbers, FIG. 1 shows a paint spray booth 10 typically used to enclose workpieces (not shown) that are sprayed by an electrostatic spray gun. The booth 10 comprises four walls 12, a floor 14 and a ceiling 16, that encloses a booth cavity 18. The booth 10 has a slot 20 and openings 22 that allow the parts, which are hung on hangers that move along a conveyor, to pass through the booth 10. The booth 10 has an access window 24 to allow a liner 26 to be inserted into the cavity of the booth 10. The liner 26 can be packed into a cabinet 28. The cabinet 28 may have wheels 30 allowing the cabinet 28 to be rolled to and from the access window 24, such that the cabinet 28 can be easily transported and attached to the booth 10. There may be a plurality of portable cabinets, each cabinet 28 corresponding to a different powder color.

FIG. 2 shows the liner 26 installed within the cavity 18 of the booth 10. Installation may be accomplished by unfolding the liner 26 from the cabinet 28, attaching the liner 26 to the booth walls 12 and ceiling 16 and inflating the liner 26 with a fluid medium 34, preferably air, from a compressor or the like (not shown). The liner 26 has a first outside layer 36 constructed to conform to the shape of the booth cavity 18 and a second inside layer 38 attached to the first layer 36, such that there is an inflatable compartment 40 between the first 36 and second 38 layers. The layers are made from a flexible bag like material that allows the compartment 40 to expand when air 34 is introduced to the same. To add structural support to the compartment 40, a support member 42 may be inserted between the first 36 and second 38 layers. In the preferred embodiment, the support member 42 is a corrugated sheet extending through the compartment 40, with the sheet being constructed from a flexible material such that the liner 26 easily collapses when the compartment 40 is deflated. The spring like sheet also aids the expansion of the compartment 40, by inducing separation of the layers to make sure certain portions of the liner 26 are not pinched or collapsed. It being desirable to have the electrically insulating air gap separating the booth and charged powder over as much area as possible, to prevent the attraction of the powder to the metallic booth walls. The second inside layer 38 can be porous, allowing the pressurized air 34 to blow through said layer 38 into the cavity 18, to prevent powdered paint from attaching to the liner 26. With this embodiment, the compressor or other source of air would have to be in constant operation to supply a constant source of pressurized air 34. The porous second inside layer can be constructed by creating a plurality of small apertures throughout the second layer 38. The liner 26 may be attached to the booth by hook and loop material sold under the Trademark "VELCRO" 44, as shown more clearly in FIGS. 3 and 4, wherein the liner 26 has patches of loops that mate with corresponding hooks attached to the booth 10. The liner 26 may be connected to the booth 10, by hooks, or hangers or any other suitable means for covering the cavity 32 walls.

The liner 26 could be constructed such that the liner 26 could cover the cavity walls without being attached to the booth 10, an embodiment particularly viable for small booths. The liner 26 would be inflated into the desired predetermined shape after the liner 26 is unfolded inside the booth cavity 18. The corrugated sheet 42 could provide additional structural support to help suspend the liner 26 within the booth cavity 18. FIGS. 3 and 4 show desirable sheet 42 shapes to help define the corners of the liner 26. The cabinet 28 and liner 26 could be constructed, such that the liner 26 is inflated while still in the cabinet 28, wherein the liner 26 "opens up" into the booth 10. In this arrangement the liner 26 would still have to be folded back into the cabinet 28 after the compartment 40 is deflated.

Figure 5:
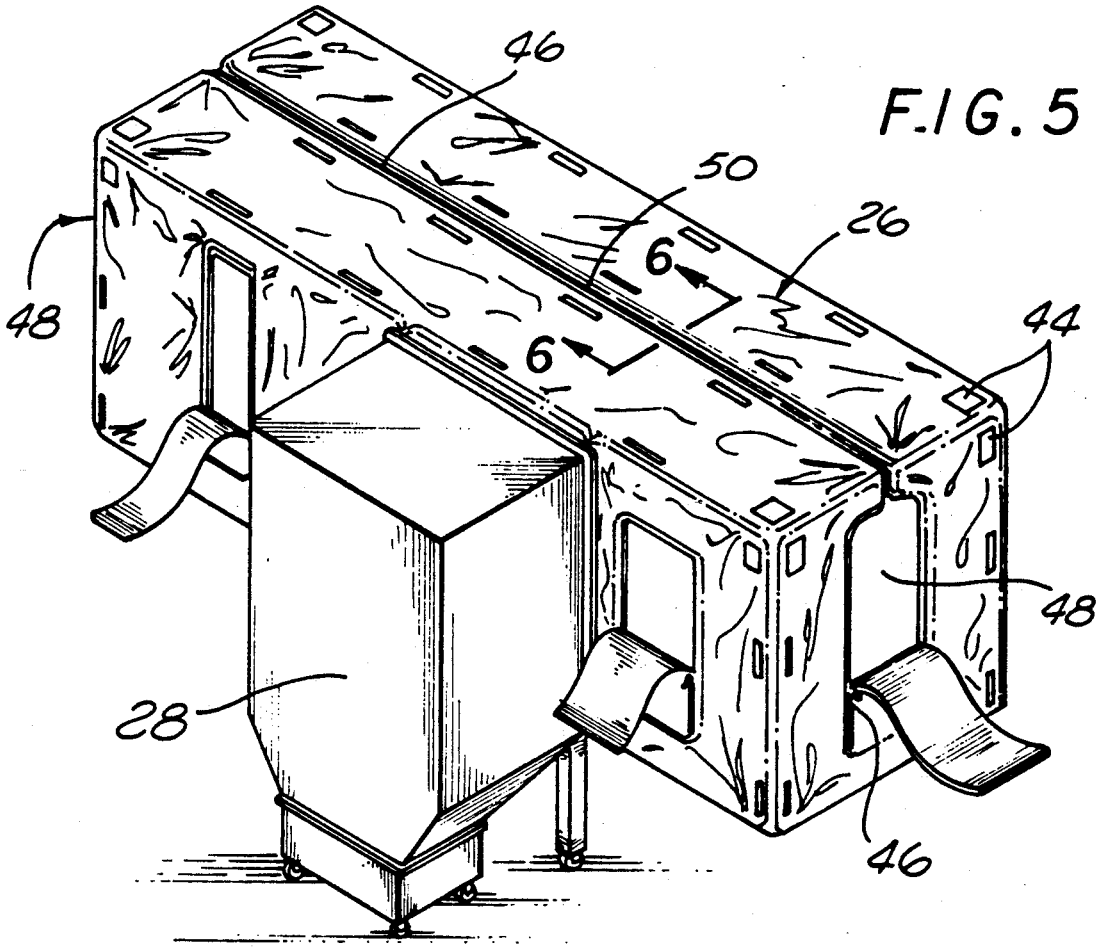
FIG. 5 is a perspective view of an inflated double layered liner showing zippers that expose openings and a slot to allow workpieces (not shown) to pass through the booth.
Figure 6:
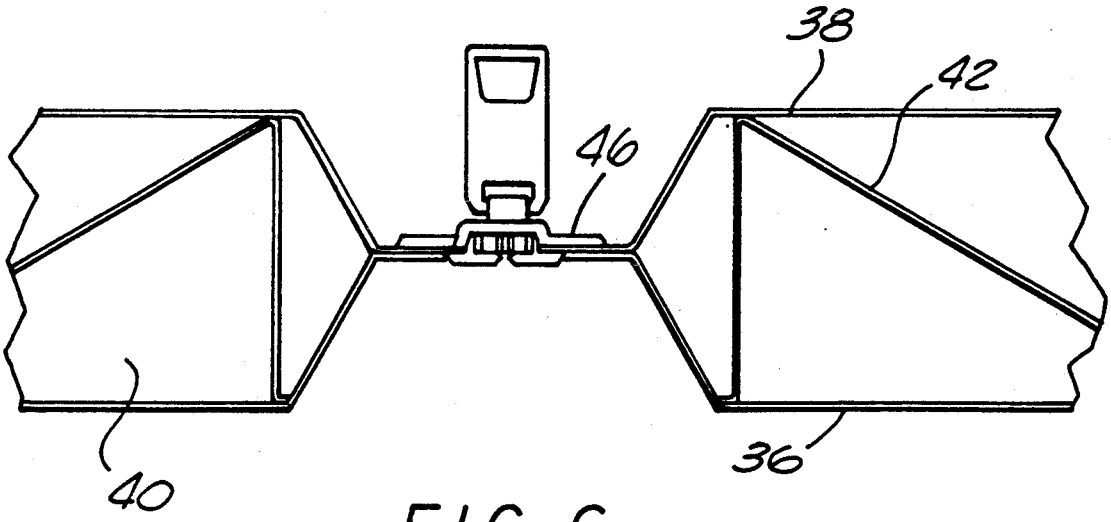
FIG. 6 is a cross-sectional view of FIG. 5 showing a zipper attached to the liner.

FIG. 5 shows an inflated liner 26, with zippers 46 that unzip portions of the liner 26, such that there are liner openings 48 and a liner slot 50 that are of approximately the same dimensions and locations as the openings 22 and slot 20 of the booth 10. The openings 48 and slot 50 allow workpieces to travel through the liner 26 and booth 10. The zippers 46 can also create side openings 51 to allow further access to the cavity for the spray gun or for other means. There may be another side opening on the opposite side (not shown) for spray gun access. FIG. 6 more clearly shows the attachment of the zipper 46 to the liner 26, wherein the zipper 46 seals off the compartment 40. The liner openings 48 and slot 50 can also be attached with hook and loop material or other fastening means.

To install the preferred embodiment a portable cabinet 28 is rolled up to the access window 24. The liner 26 is unfolded into the booth cavity 18. The compartment 40 is then inflated to a point where it can be attached to the cavity walls 12. The zippers 46 are unzipped creating the openings 48 and slot 50. The liner 26 is then ready for use. When a new color is desired, the liner 26 is zipped, deflated, detached and folded back into the cabinet 28, which is wheeled away and replaced by another cabinet 28 to be used with the new color.

The liner 26 could be utilized as a self-supporting paint spray enclosure, wherein the liner is used without a metallic booth 10. The layer material and/or corrugated sheets could provide enough structural rigidity such that the liner is defined and self-supported as shown in FIG. 5. To provide further support, the corners of the liner 26 could be tied to the floor and ceiling such that the liner is suspended like a tent. Thus the present invention could be used as a replacement for the expensive heavy booths that are used today. By deflating and removing the liner the floor space can then be utilized for other uses.

Figure 7:
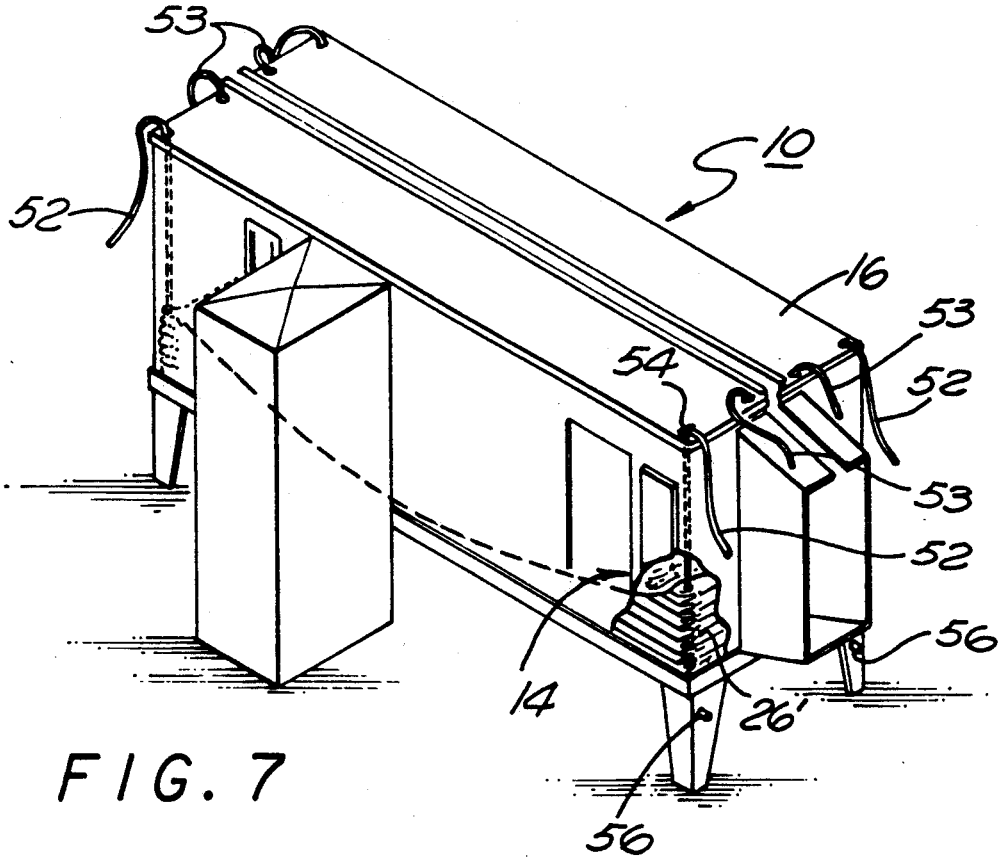
FIG. 7 is a perspective view showing a spray paint booth with a liner than can be lifted into position by cables.
Figure 8:
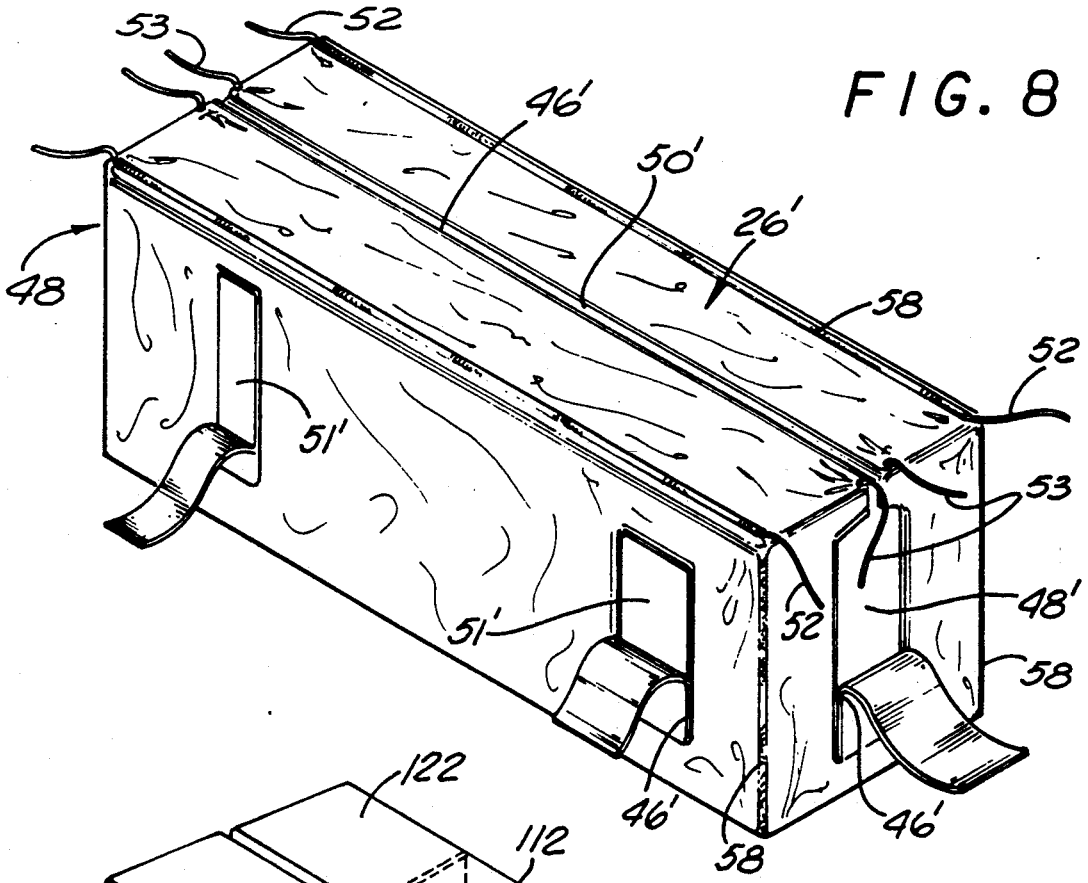
FIG. 8 is a perspective view similar to FIG. 5, showing the liner of FIG. 7.

FIGS. 7 and 8 show an alternate embodiment of a single layer liner 26' that can be lifted into position from outside the spray booth 10. The liner 26' may have zippers 46' that allows openings 48' and 51', and a slot 50' to be formed therein. The corners of the liner 26' can be attached to cables 52 that extend through openings 54 in the the booth 10. The liner 26' may also have cables 53 attached to the edges of the liner adjacent to the slot 50'. The cables 53 insure that the liner 26' is adjacent to the cavity wall in the area around the slot 50'.

Figure 9:
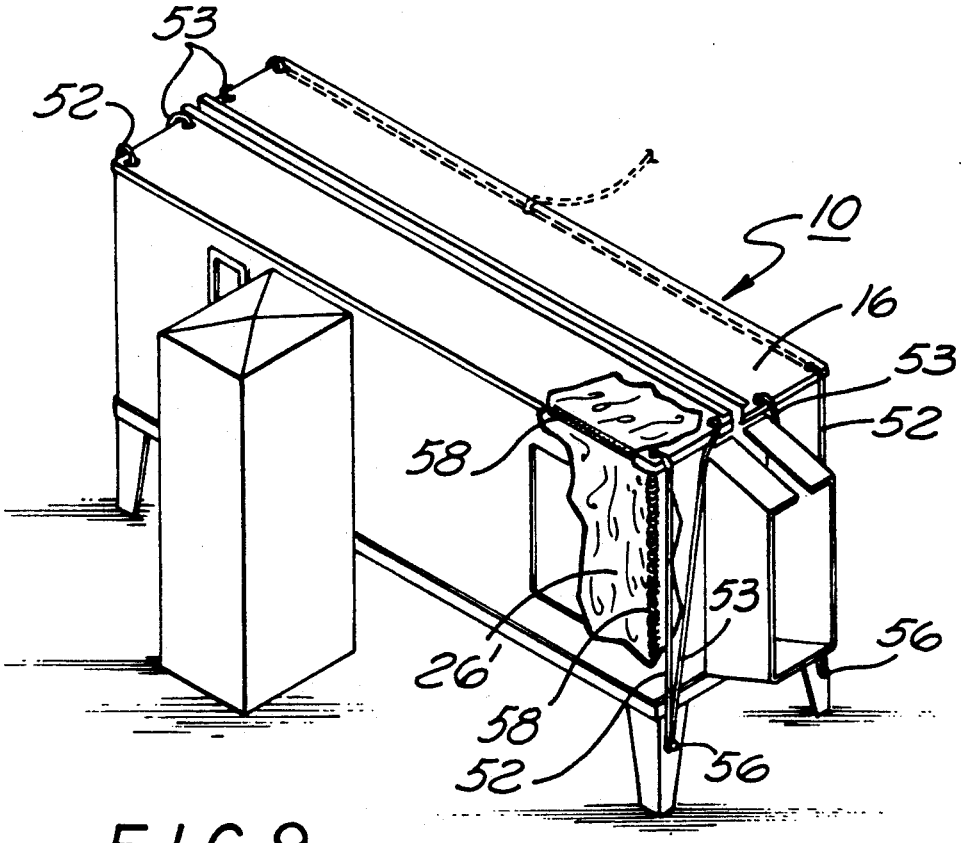
FIG. 9 is a view similar to FIG. 7 showing the liner lifted into an operating position.

The liner 26' is initially in a flat position on the floor 14 of the booth. As shown in FIG. 9, the liner 26' is lifted into position by pulling the cables 52 and 53 in a downward direction, until the top and sides of the liner 26' completely cover the inner surface of the booth 10. The bottom corners of the liner 26' are typically fastened to the floor 14, to prevent the bottom of the liner from being pulled up by the cables.

To keep the liner 26' upright, the cables 52 can be tied to studs 56 extending from the legs of the booth 10. The liner 26' may have four individual cables 52, or two pairs of cables as shown in phantom in FIG. 9. The combination of cables reduces the number of people or steps needed to lift the liner 26'. The edges of the liner 26' preferably have an elastic element 58 or material therein, so that when the cables are untied, the elastic material 58 pulls the liner 26' back into the flat position. The liner 26' can then be folded and removed from the booth. A new liner may be unfolded onto the floor 14 and lifted into place. The new liner is typically used when a different color of paint is sprayed onto the workpieces. The cables 52 and 53 can be attached to a single layer liner or the double layer liner shown in FIGS. 1–6.

Figure 10:
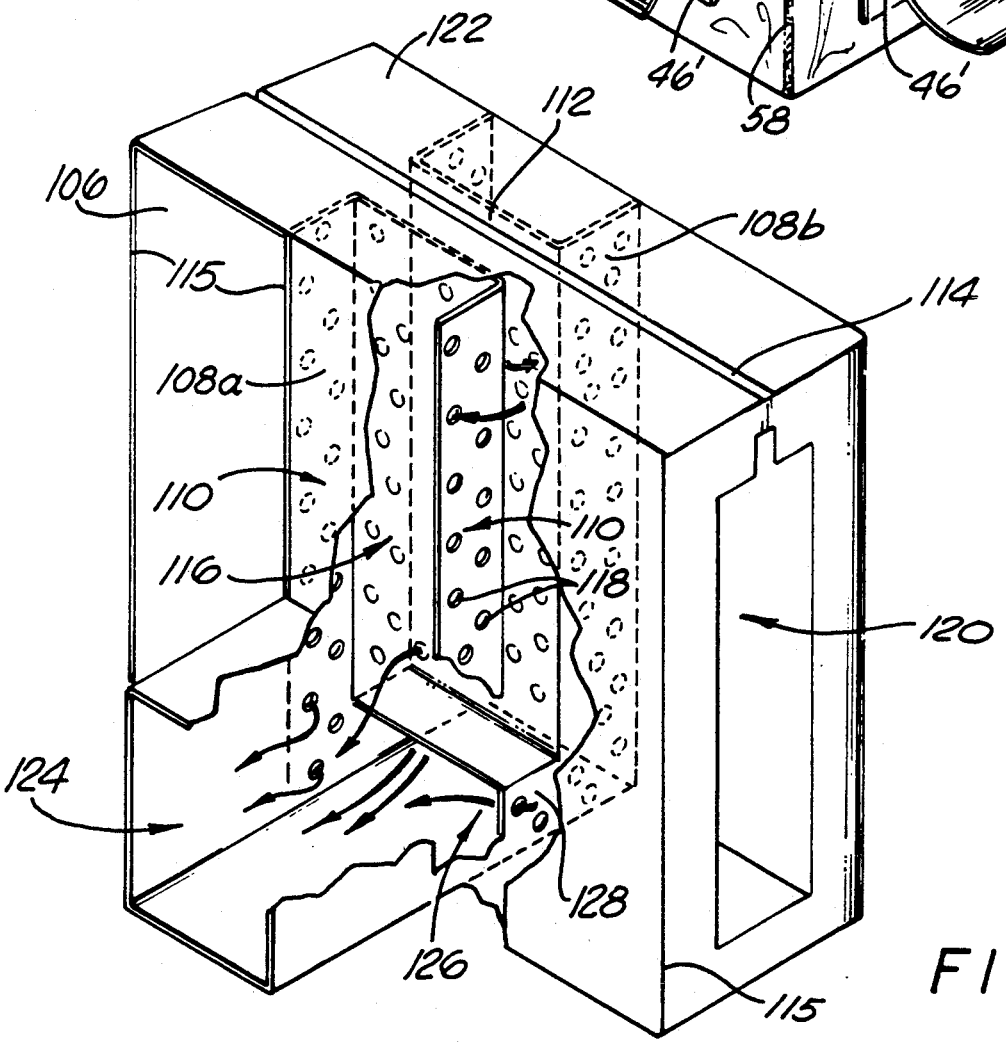
FIG. 10 is a perspective view of another alternate embodiment of the present invention, wherein the liner has a pair of air ducts integrated therein.

FIG. 10 shows another embodiment of the present invention, wherein the liner 106 has a pair of air ducts **108*a* and 108*b* integrated therein. The liner 106 may be the double layer liner shown in FIGS. 1–6 or the single layer liner shown in FIGS. 7–9. Each duct 108 typically has a pair of sidewalls 110 that extend from the liner 106. Attached to each sidewall 110 is a front wall 112 that is essentially parallel with the slot 114. The edges of the walls may contain elastic material 115, so that the ducts 108 readily collapse when the cables are released (single layer), or the compartment is deflated (double layer). The ducts 108 have inner passages 116 extending the length of the walls. Each wall also has a plurality of holes 118 that provide communication between the inner cavity 120 of the booth 122 and the passages 116**.

Attached to the booth 122 is a filter unit 124 that contains a number of filters (not shown) that remove the electrostatic paint powder from the air. The liner 106 has an opening 126 that provides communication between the duct passage 116 and the filter unit 124. Because only one filter is typically employed, the liner 106 may include a secondary duct 128 that allows air to flow from the duct **108*b* to the duct 108*a*. A fan unit (not shown) is typically employed to pull the air from the inner cavity 120 of the booth, through the filters and into the ambient. The ducts provide a means for directing the paint powder to the filter, thereby reducing the amount of paint powder that adheres to the liner 106**.

While certain exemplary embodiments have been described above and shown in the accompanying drawings, it is to be understood that the embodiments are merely illustrative of, and not restrictive on the broad invention. It also being understood that this invention should not be limited to the specific constructions and arrangements shown and described, since various other modifications may occur to persons having ordinary skill in the art.

What is claimed is:

1. A powder paint spray booth assembly for spraying workpieces with an electrostatic paint powder by a spray gun operatively connected to the assembly, comprising:

a spray booth with an inner cavity defined by four walls and a top, said walls having a pair of spray booth openings that allow the workpieces to enter and exit said spray booth openings that allow the workpieces to enter and exit said spray booth, said top having a slot that allows the workpieces to pass through said spray booth, said spray booth further having at least four openings;

a collapsible liner adapted to cover said inner cavity walls and top, said liner having liner openings and a liner slot that allow the workpieces to move through said spray booth, said liner being adapted to move between a flat position and an expanded position; and, at least two first cables attached to said liner and extending through said openings, such that said liner can be lifted to cover said inner cavity walls and top by pulling said cables.

2. The assembly as recited in claim 1, wherein said liner has elastic material that biases said liner into said flat position.

3. The assembly as recited in claim 1, further comprising at least two second cables attached to a pair of liner edges that define said liner slot.

4. The assembly as recited in claim 1, further comprising a first zipper operatively connected to said liner, such that said liner slot is created when said first zipper is in an open position.

5. The assembly as recited in claim 4, further comprising a pair of second zippers operatively connected to said liner, such that said liner openings are created when said second zippers are in open positions.

6. The assembly as recited in claim 1, wherein said liner has a pair of collapsible ducts that can be lifted by said cables into an operating position, said ducts being constructed to direct the paint powder from said inner cavity to a filter attached to said spray booth.

7. The assembly as recited in claim 1, wherein said liner has a first layer adapted to conform to said inner cavity and a second layer attached to said first layer and said second layer.

8. A method of installing a liner in a spray booth having four cable openings and an inner cavity defined by four walls and a top, comprising the steps of:

providing;

a collapsible liner adapted to cover the inner cavity walls and top, said liner being adapted to move between a flat position and an expanded position;

at least two cables attached to said liner and extending through the cable openings, such that said liner can be lifted to cover the inner cavity walls and top by pulling said cables;

attachment means for fastening said cables such that said liner is retained in said lifted position;

pulling said cables until said liner is in said lifted position, and fastening said cables to maintain said liner in said lifted position.

* * * * *

UNITED STATES PATENT AND TRADEMARK OFFICE

CERTIFICATE OF CORRECTION

PATENT NO. : 5,240,504

DATED : August 31, 1993

INVENTOR(S) : Mazakas

It is certified that error appears in the above-identified patent and that said Letters Patent is hereby corrected as shown below:

In claim 7, in column 6 at line 63 between "to said first layer" and "and said second layer." insert --such that there is an inflatable compartment between said first layer--.

Signed and Sealed this

Sixth Day of June, 1995

Bruce Lehman

*Attest:*

BRUCE LEHMAN

*Attesting Officer*

*Commissioner of Patents and Trademarks*